United States Patent [19]

Beduhn et al.

[11] 4,103,783

[45] Aug. 1, 1978

[54] PLATFORM CRANE WITH COUNTERWEIGHT AND BOOM CARRIER SUPPORT LINKAGES

[75] Inventors: Daniel E. Beduhn; James G. Morrow, Sr.; David J. Pech, all of Manitowoc, Wis.

[73] Assignee: The Manitowoc Company, Inc., Manitowoc, Wis.

[21] Appl. No.: 854,479

[22] Filed: Nov. 25, 1977

Related U.S. Application Data

[60] Continuation-in-part of Ser. No. 801,597, May 31, 1977, abandoned, which is a division of Ser. No. 709,451, Jul. 28, 1976, Pat. No. 4,042,115.

[51] Int. Cl.[2] ..... B66C 23/72

[52] U.S. Cl. ..... 212/48; 212/66

[58] Field of Search ..... 212/48, 49, 66, 69, 212/59 R; 37/116, 189, 190; 214/132

[56] References Cited

U.S. PATENT DOCUMENTS

| | | | |
|---|---|---|---|
| 1,289,427 | 12/1918 | Ferris | 212/69 |
| 2,440,199 | 4/1948 | Huston | 212/59 A |
| 2,509,686 | 5/1950 | Huston | 212/59 A |
| 2,589,915 | 3/1952 | Wullschleger | 212/58 R |
| 2,602,551 | 7/1952 | White | 212/59 A |
| 2,910,189 | 10/1959 | Scheuerpflug | 212/59 R |
| 3,955,684 | 5/1976 | Novotny | 212/48 |

FOREIGN PATENT DOCUMENTS

| | | | |
|---|---|---|---|
| 2,340,154 | 8/1972 | Fed. Rep. of Germany | 212/48 |
| 140,554 | 4/1960 | U.S.S.R. | 212/49 |

*Primary Examiner*—Lawrence J. Oresky
*Attorney, Agent, or Firm*—Leydig, Voit, Osann, Mayer & Holt, Ltd.

[57] ABSTRACT

A crane assembly which, in heavy lifting configuration, has a platform with boom carrier and counterweight support rotatably mounted on a ring with the mounting including a king pin removably secured to the ring. The platform will easily accept a variety of hoisting machinery. Not only are the boom, mast and ring suitable for other crane configurations, but also the counterweight support and boom carrier are standard subcombinations held rigid with the platform through links defining triangular frames.

2 Claims, 5 Drawing Figures

PLATFORM CRANE WITH COUNTERWEIGHT AND BOOM CARRIER SUPPORT LINKAGES

This application is a continuation-in-part of copending application Ser. No. 801,597, filed May 31, 1977 now abandoned, which is a divisional of application Ser. No. 709,451, filed July 28, 1976, now U.S. Pat. No. 4,042,115 issued Aug. 16, 1977.

The present invention relates generally to high capacity lift cranes and more particularly concerns an assembly of crane components for lifting and transporting heavy loads.

Modern lift crane design is faced with a number of conflicting requirements. In the first place, high capacities are demanded, involving combinations of booms hundreds of feet long and loads ranging up to 1200 tons. Such high capacities are best handled by fixed or semi-portable configurations like the large ring concept disclosed and claimed in U.S. Pat. No. 3,485,383, issued Dec. 23, 1969, and owned by applicants' assignee. Most crane users also demand some degree of portability, which becomes increasingly difficult as designs are scaled up to handle greater loads.

Finally, the question of economy is always present and with larger, inherently more expensive, devices the typing up of apparatus in a configuration where that apparatus is not utilized becomes increasingly costly.

It is therefore the primary aim of the present invention to provide a crane assembly made up of crane components that can be readily manipulated to create a high capacity crane that is semi-portable.

Another object of the invention is to provide an assembly as referred to above whose individual components are themselves relatively inexpensive, and which does not, in an operating mode, immobilize and leave inactive large components of sub-assemblies.

A further object is to provide a crane assembly of the above character that is not only versatile in the senses already mentioned, but which has further versatility in the sense of having components compatible with other crane systems and of being well suited for easily mounting a variety of machinery or machinery combinations to satisfy desired applications.

Other objects and advantages of the invention will become apparent upon reading the following detailed description and upon reference to the drawings, in which.

While the invention will be described in connection with a preferred embodiment, it will be understood that we do not intend to limit the invention to that embodiment. On the contrary, we intend to cover all alternatives, modifications and equivalents as may be included within the spirit and scope of the invention as defined by the appended claims.

Figure 1:
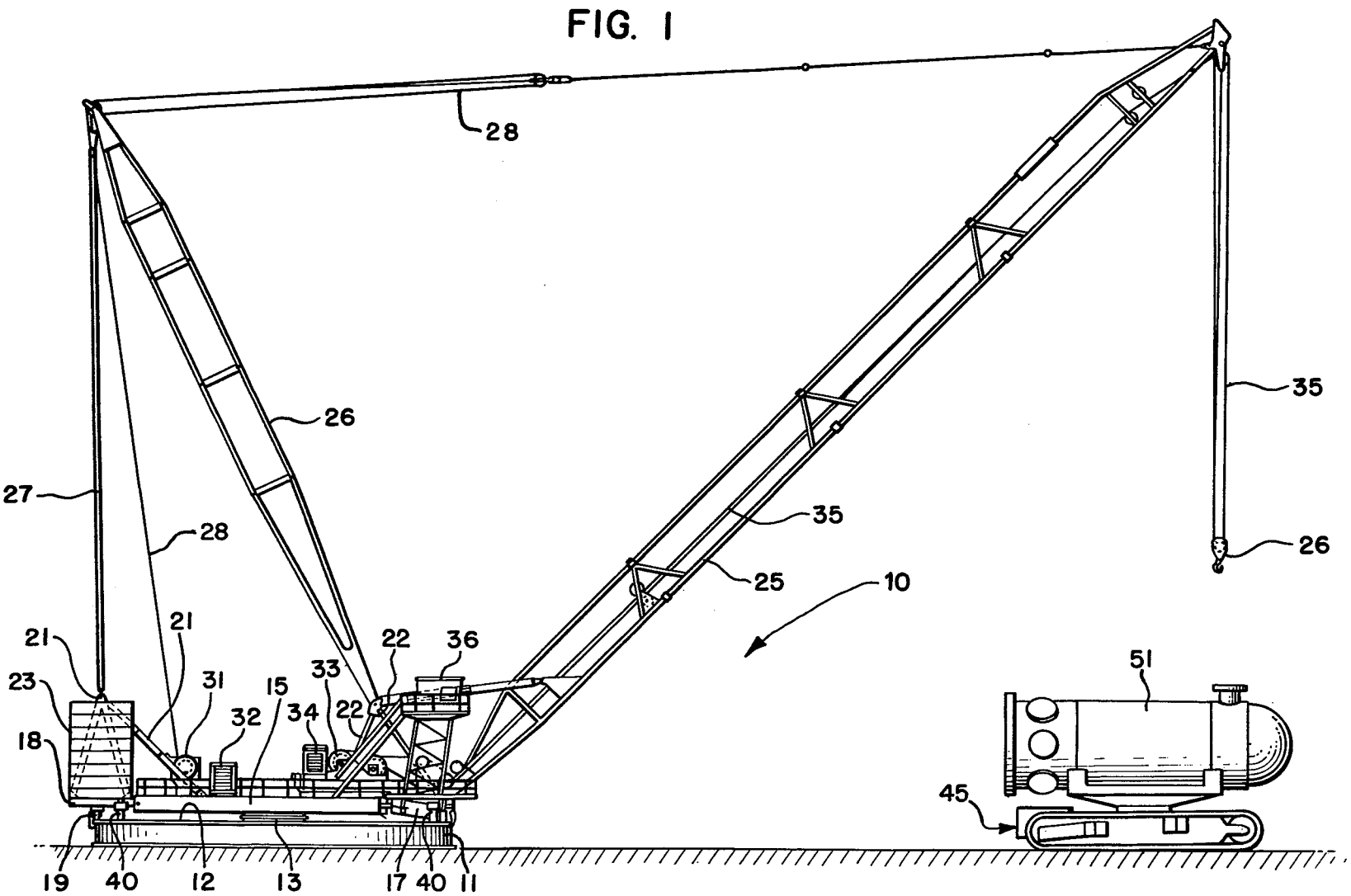
FIG. 1 is a side elevation of a crane assembly embodying the invention in a high capacity lifting configuration.
Figures 2, 3, 4:
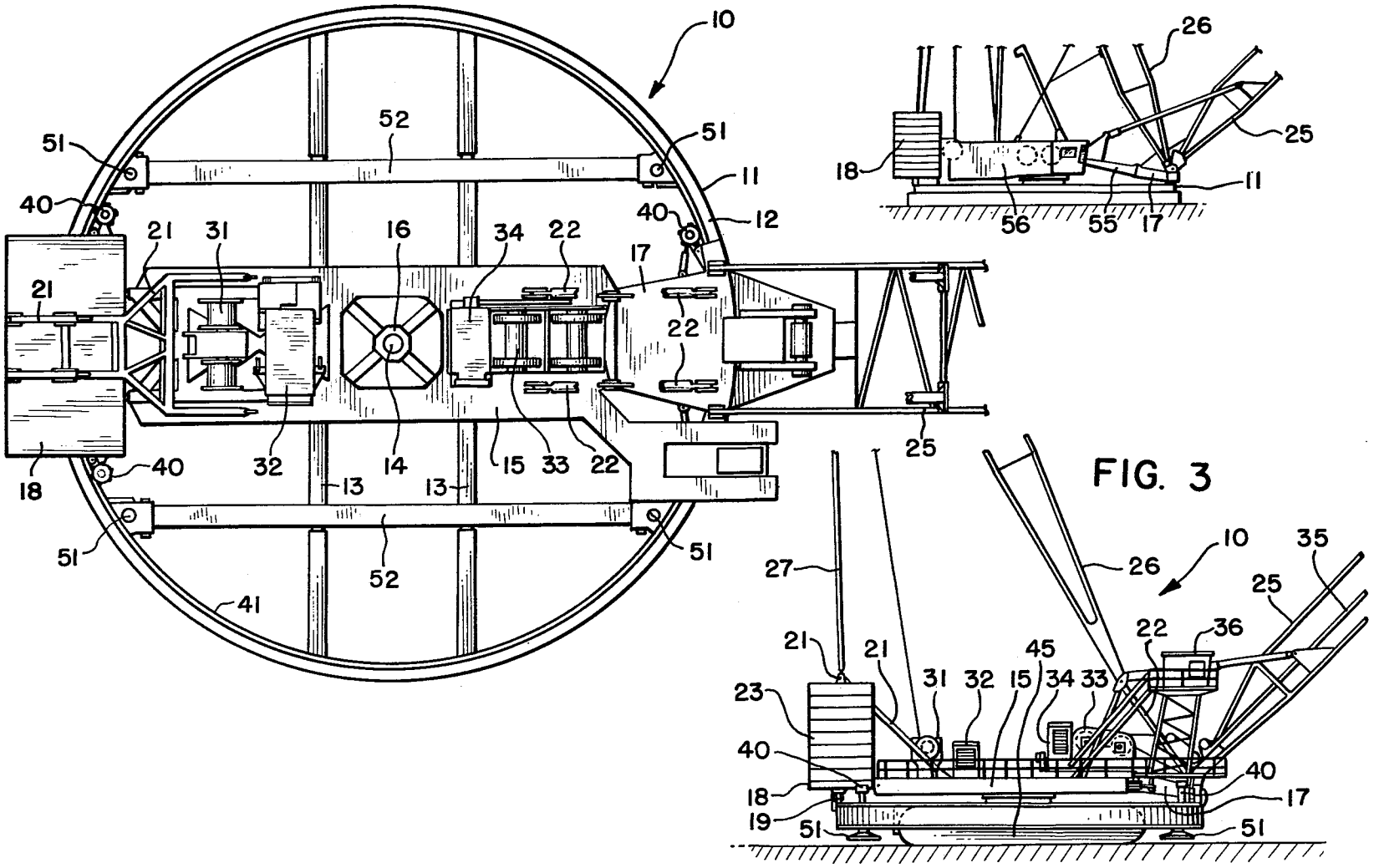
FIG. 2 is a plan, with some components sectioned, of the crane assembly shown in FIG. 1.
FIG. 3 is a fragmentary side elevation similar to FIG. 1 but showing the crane assembly in portable configuration.
FIG. 4 is a fragmentary elevation showing components of the FIG. 1 crane assembly utilized in an alternate crane system; and, FIG. 5 is a side elevation similar to FIG. 1 of another alternate crane system.

Turning first to FIGS. 1 and 2, there is shown a crane assembly 10 embodying the invention and including a ring 11 defining an annular track 12, structure 13 within the ring 11 supporting and including a central king pin 14, and an elongated platform 15 having a central sleeve 16 fitted for rotation on the king pin 14. It is one of the features of the invention that the platform 15 is simply that, a plain box-like weldment, having a boom carrier 17 pinned at one end in riding contact with the track 12 and a counterweight support 18 pinned at the other end also in riding contact with the track 12. The carrier 17 and the support 18 mount wheels 19 which ride on the track 12.

In carrying out the invention, first and second sets of links 21 and 22 define large triangular frames interconnecting the platform 15 and the respective carrier 17 and support 18 so as to hold these parts relatively rigid. Items of counterweight 23 are stacked on the support 18 so that the counterweight load, when the crane assembly is not operating, is transmitted directly to the track 12. A boom 25 with a load block 26 is pivoted on the carrier 17 just above the track 12 so that the fulcrum or tipping point for the load handling system is directly through the track.

As a feature of the invention, a mast 26, rigid links or pendants 27 and rigging 28 interconnect the counterweight support 18 and the boom 25 for positioning the boom through a vertical arc, with the mast 26 being secured to the platform at an upper portion of the second set of links 22 so that there is a substantially straight compression load line from the top of the mast 26 down to the boom pivot and fulcrum point, and with the links 22 defining an open, uncluttered region between the platform 15, the carrier 17 and the boom 25 for the passage and guidance of appropriate rigging. Since the platform 15 is simply a platform, a wide variety of power hoists can be readily mounted for power control of the boom 25 and its load block 26. In the illustrated embodiment, one hoist assembly 31 with its power plant 32 is mounted at the rear of the platform 15 for powering the boom hoist rigging 28, and a second hoist assembly 33 with its separate power plant 34 is mounted at the front of the platform 15 for powering the load block 26. The second hoist assembly 33 is fitted within and under the second set of links 22, and the open, uncluttered region allows appropriate fleeting sheaves and other rigging controls to be easily mounted for controlling lines 35 interconnecting the hoist assembly 33 and the load block 26.

An elevated operator's house 36 is also mounted at one front side of the platform 15 and is provided with suitable controls for operating the various powered elements of the assembly. For rotating the platform 15 on the ring track 12, a plurality, four in the illustrated case, of swing assemblies 40 with power driven gears are mounted on the platform 15 and biased into engagement with a gear path 41 fixed on the ring 11. Swing drives of this kind are claimed and disclosed in greater detail in U.S. Pats. Nos. 3,949,889 and 4,013,174, both assigned to the assignee of the present case.

As more fully disclosed in U.S. Pat. No. 4,042,115, the king pin support structure 13 is removable, as is a section of the track ring 11 so that a self-propelled transporter 45 having a king pin structure can be run within the ring 11 and beneath the platform 15, and connected to the ring and platform to create a mobile assembly. The transporter 45 is preferably similar to that claimed and disclosed in greater detail in U.S. patent applications Ser. No. 571,303, filed Apr. 24, 1975 and Ser. No. 685,689, filed May 12, 1976, both assigned to the assignee of the present invention. With the crane assembly 10 in its FIG. 1, lifting configuration, the transporter 45 is available for carrying heavy loads such as the illustrated vessel 51. The transporter 45 fits within the ring 11 between ring supporting beams 52 as shown in FIG. 2, and when the platform 15 and ring 11 are secured to the transporter, the assembly becomes mobile, as illustrated in FIG. 3, without further disassembly. To reverse the procedure when the crane assembly 10 has been walked to a new working position, the ring segment is removed, the ring and platform detached from the transporter 45, and the transporter walked out to be replaced by the removable king pin assembly 13.

For facilitating the conversion from mobile configuration to a stationary lifting configuration, hydraulic jacks 51 are mounted on the ring 11 for selectively elevating the ring to permit ready disengagement of the platform 15 from the king pin structure on the transporter 45. Conversely, the jacks permit elevating the ring so that the transporter 45 can be readily positioned beneath the platform for engagement of the transporter king pin with the platform sleeve 16.

One of the features of the invention is the versatility inherent in having the assembly 10 made up of standard sub-assemblies. FIG. 4 shows the ring 11, boom carrier 17, boom 25, mast 26, and counterweight support 18 assembled together with a carrier extension 55 and a standard mobile crane 56 into the crane configuration claimed and disclosed in U.S. Pat. No. 3,485,383 referred to above. While the FIG. 4 assembly is an effective way of greatly increasing the capacity of the mobile crane 56, it can be readily understood that the basic crane 56 employed as a sub-assembly in the FIG. 4 arrangement is substantially more complex and expensive than the relatively simple platform 15 and its components, although the geometry being virtually identical, the FIG. 1 configuration gives virtually the same capacity as the FIG. 4 arrangement.

Figure 5:
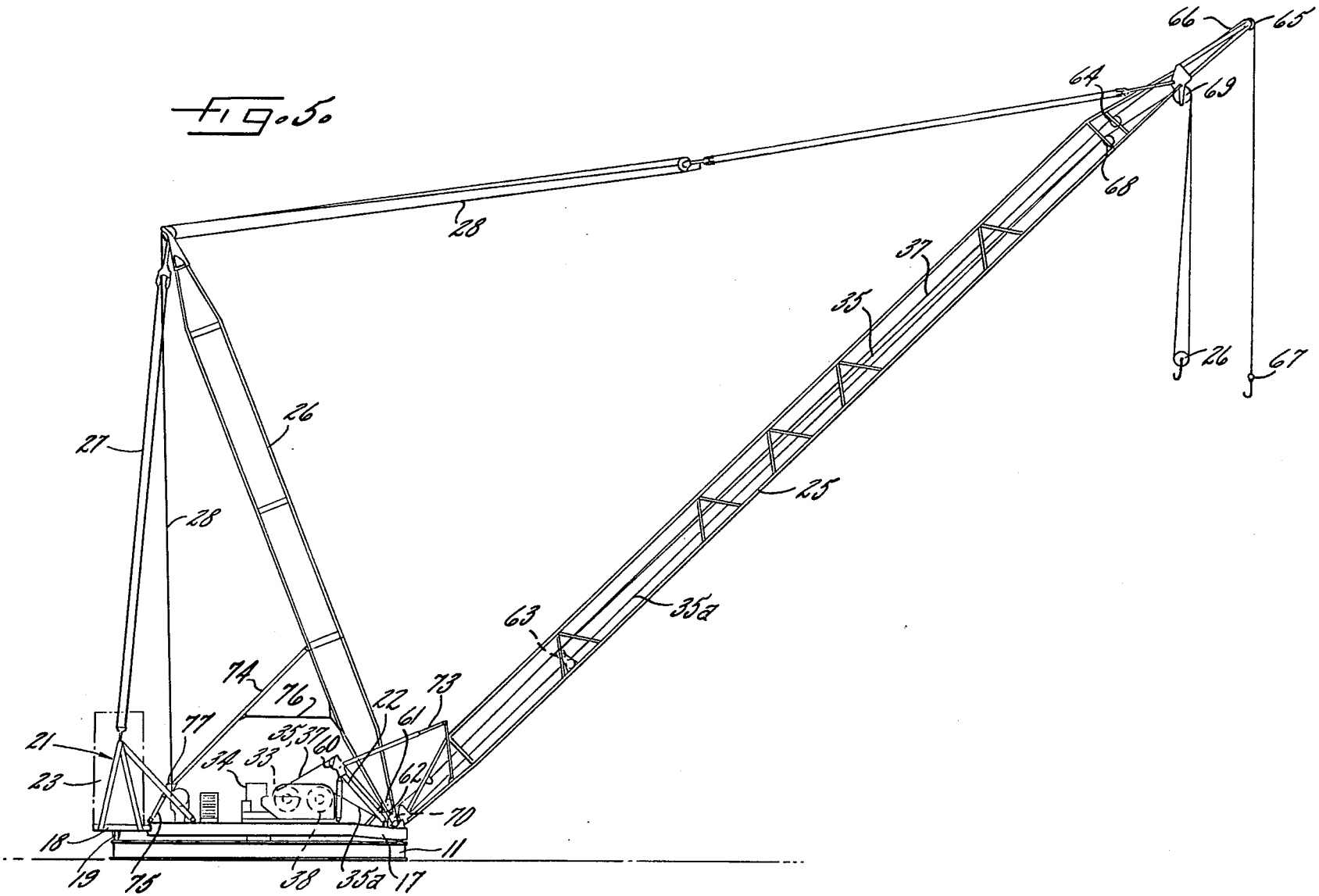

An alternative platform type crane arrangement is illustrated in FIG. 5, but with the operator's cab removed to better illustrate other details. Also, as shown here, the mast 26 is pivotally mounted directly on a forward portion of the boom carrier 17 with its fulcrum point passing through the ring 11. The crane in FIG. 5 is also rigged with two active load lines 35 and 37 respectively wound on the drums of hoist assemblies 33 and 38 driven by power plant 34. In the illustrated embodiment, hoist assembly 33 is a dual drum hoist, with each drum being selectively driven by the power plant 34.

In keeping with the invention, the forward triangular linkage 22 is provided with means for guiding one end of the lines 35 and 37 past the hoist assembly 38 and onto the split drums of hoist assembly 33. To this end, the linkage 22 carries a pair of laterally movable fleeting sheaves 60 (only one of which is shown) adjacent its upper end over which the lines 35 and 37 are guided. A pair of lower fleeting sheaves 61 (only one of which is shown) are also mounted on a smaller triangular frame 62 for directing the hoist lines 35 and 37 generally upwardly along the boom 25. Hoist line 37, sometimes referred to as a whip line, passes over guide sheaves 63 and 64 journalled on the boom 25 and a tip sheave 65 journalled on a boom tip extension (or jib) 66 and supports an auxiliary hook 67. In the illustrated embodiment, one end of the main load line 35 is guided over sheaves 63, 68 and 69 and then down to the main hook block 26. The other end **35*a* of the main load line is wound on the drum of hoist assembly 38 and passes under a fleeting sheave 70 mounted on the sub-frame 62**.

Also pursuant to the invention, the upper portion of triangular linkage 22 provides a rigid attachment point for a cushioned boom stop 73 which prevents the boom 25 from being raised to a nearly vertical position where it might be in danger of toppling over backwards. The rear triangle 21 also affords a convenient anchor point for a strut 74 supporting the mast 26 at a predetermined angle. In order to keep these components as lightweight as possible the leg of the triangular linkage 21 may be braced by a link 75 and the strut 74 is held in fixed angular position by a stay 76 which interconnects the strut 74 and the mast 26. The lower end of the strut 74 is received in a compression socket 77 supported by the triangular linkage 21 and the link 75.

From the foregoing, it will be appreciated that the rear triangular linkage 21 in addition to supporting the counterweight platform 18 also receives and supports the free end of the mast strut 74 in the compression socket 77. Similarly, the forward triangular linkage 22 not only provides an open uncluttered region between the platform 15 and the boom carrier 17 for the passage of the rigging lines 35, 37, over fleeting sheaves 60, but also provides an anchor point for the cushioned boom stop 73. Additionally, the lower triangular frame 62 supports the lower fleeting sheaves 61 which direct the load lines 35, 37 generally upward along the boom 25. Thus, the present invention provides for a very versatile rigging arrangement for a high lift capacity crane which may employ either a platform mount, a transporter mount or a conventional crane mount within a load bearing ring 12.

We claim as our invention:

1. In a crane assembly, the combination comprising, a ring defining an annular track, an elongated platform mounted for rotation on said ring, said platform having a boom carrier extending at one end therefrom and having roller means in riding contact with said track and a counterweight support means for supporting a counterweight at the other end also having roller means in riding contact with said track, a first set of links defining a triangular frame substantially rigidly interconnecting said counterweight support means and said platform, a second set of links defining a triangular frame substantially rigidly interconnecting said boom carrier and said platform, whereby said platform, counterweight support means and boom carrier are supported as a unit for rotation on said ring said second set of links defining an open, uncluttered region between said platform and said carrier for passage and guidance of rigging, a boom pivoted on said carrier over said track, a cushioned boom stop secured at an upper portion of said second set of links for arresting rearward tilting of said boom beyond a predetermined angle, a mast pivoted on said carrier over said track, a mast strut supported by said first set of triangular links for arresting rearward tilting of said mast beyond a predetermined angle, and a stay interconnecting a central portion of said mast strut and said mast.

2. The combination of claim 1 including a third triangular linkage disposed forward and below said second triangular linkage and a first pair of fleeting sheaves supported at the upper end of said second linkage and a second pair of fleeting sheaves supported at the upper end of said third linkage for guiding said rigging.

* * * * *